US011531302B2

(12) United States Patent
Watanabe

(10) Patent No.: US 11,531,302 B2
(45) Date of Patent: Dec. 20, 2022

(54) IMAGE FORMING DEVICE HAVING TOP PLATE WITH BURRED OPENINGS

(71) Applicant: Konica Minolta, Inc., Tokyo (JP)

(72) Inventor: Kanehiro Watanabe, Sagamihara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/496,897

(22) Filed: Oct. 8, 2021

(65) Prior Publication Data

US 2022/0113670 A1 Apr. 14, 2022

(30) Foreign Application Priority Data

Oct. 8, 2020 (JP) ..... JP2020-170249

(51) Int. Cl.
*G03G 21/00* (2006.01)
*G03G 21/20* (2006.01)
*G03G 21/16* (2006.01)

(52) U.S. Cl.
CPC ..... *G03G 21/206* (2013.01); *G03G 21/1619* (2013.01); *G03G 2221/1645* (2013.01); *G03G 2221/1678* (2013.01)

(58) Field of Classification Search
CPC ..... G03G 21/1619; G03G 21/1678; G03G 21/206; G03G 2221/1645; B41J 29/377; F24F 7/02; F24F 7/10; F24F 2007/0025; H02B 1/56; H02B 1/565
USPC ..... 399/92, 107; 312/236; 454/275; 174/522; 361/678, 679.46, 679.49, 679.5, 361/688, 692, 693
See application file for complete search history.

(56) References Cited

U.S. PATENT DOCUMENTS 9,972,298 B2 * 5/2018 Ishida ..... G10K 11/002
2001/0031152 A1 * 10/2001 Kaneko ..... G03G 15/0194 399/116
2010/0207323 A1 * 8/2010 Kumeta ..... B65H 5/38 271/264
2015/0241838 A1 * 8/2015 Ishida ..... G03G 21/1619 181/175

FOREIGN PATENT DOCUMENTS

JP 2018180452 A 11/2018
JP 2020034216 A * 3/2020 ..... B05D 3/067
KR 20200117150 A * 10/2020

* cited by examiner

*Primary Examiner* — Robert B Beatty
(74) *Attorney, Agent, or Firm* — Cantor Colburn LLP

(57) ABSTRACT

Provided is an image forming device includes a top plate that is part of a case of a body of the image forming device. An opening is formed on the top plate, and the opening is processed by burring.

10 Claims, 4 Drawing Sheets

IMAGE FORMING DEVICE HAVING TOP PLATE WITH BURRED OPENINGS

CROSS-REFERENCE TO RELATED APPLICATIONS

The present invention claims priority under 35 U.S.C. § 119 to Japanese Application No. 2020-170249 filed Oct. 8, 2020, the entire content of which is incorporated herein by reference.

BACKGROUND

Technological Field

The present invention relates to an image forming device.

Description of the Related Art

Conventionally, there have been image forming devices of the electrophotographic type that form an image on a sheet by developing an electrostatic latent image on a photoreceptor with toners to form a toner image, transferring the formed toner image onto a sheet, and heating the transferred toner image to fix it onto a sheet.

In such an image forming device, there is a tendency of increase in the print speed so as to meet the market needs of the productivity improvement. Along with the increase in the print speed, there is also a tendency of increase in the temperature in the device. Therefore, for the purpose of suppressing increase in the temperature in the device, a heat insulation duct is provided between the image former and the fixing device, for example, and there has been proposed an image forming device with openings through which refrigerant introduced in that heat insulation duct is ejected in the area between the image former and the fixing device (ex. JP 2018-180452 A).

SUMMARY

However, in the image forming device disclosed in the above-referenced JP 2018-180452 A, a heat generated from the fixing device is prevented from reaching the image former, but the cooling performance in the device is insufficient. For example, as an opening for an air inlet or outlet is provided on a top plate of the case of the main body, it is possible to improve the cooling performance in the device. However, that may cause problems such as reduction of the strength of the top plate and generation of the wind noise.

The present invention has been conceived in view of the above-described problems, and has an object of providing an image forming device that has an improved strength in a top plate having an opening for improvement of the cooling performance in the device and that can suppress the noise.

To achieve at least one of the abovementioned objects, according to an aspect of the present invention, an image forming device reflecting one aspect of the present invention includes:

a top plate that is part of a case of a body of the image forming device, wherein an opening is formed on the top plate, wherein the opening is processed by burring.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein.

DETAILED DESCRIPTION OF THE EMBODIMENTS

Hereinafter, one embodiment of the present invention is described in detail with reference to the drawings.

Figure 1:
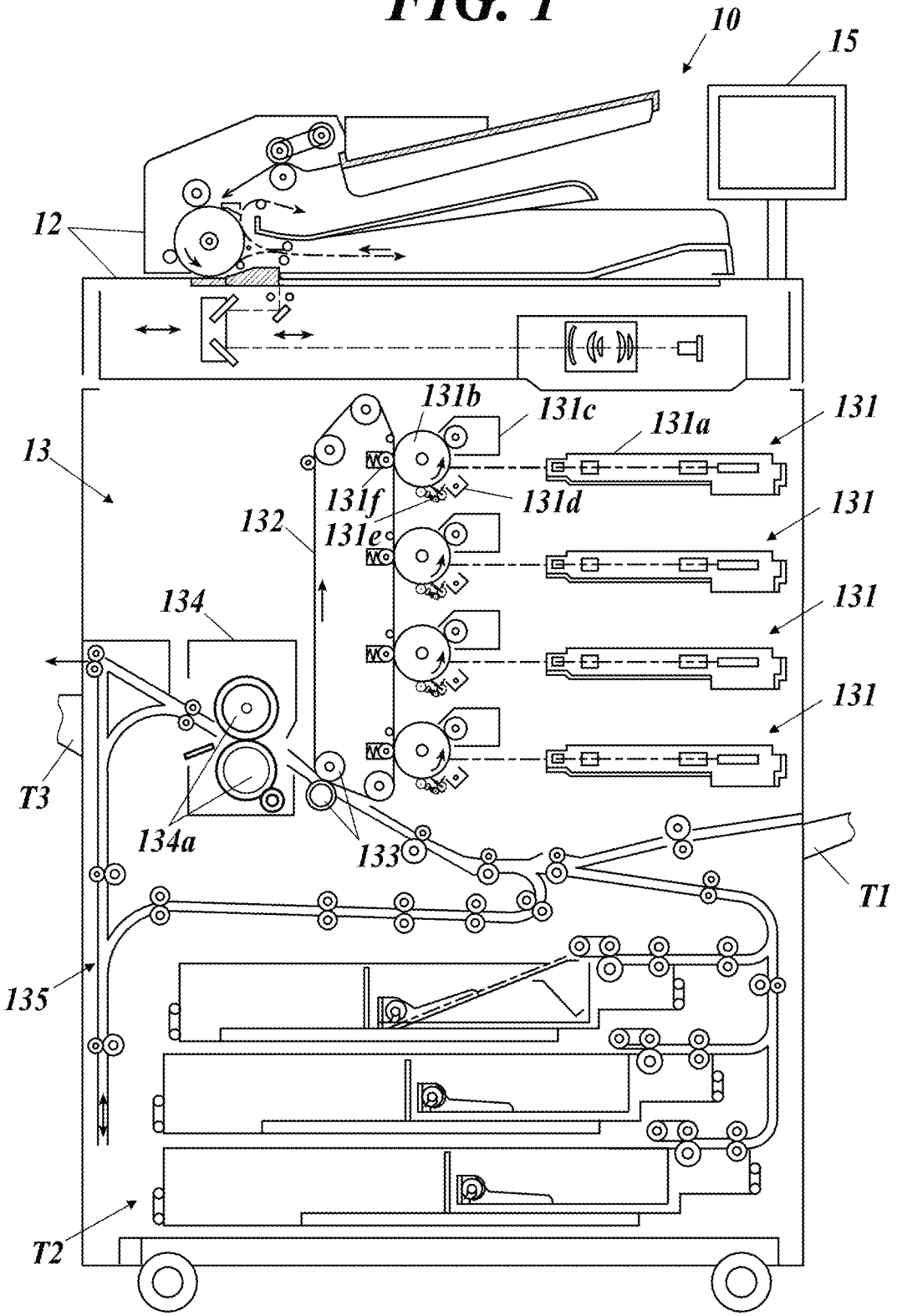
FIG. 1 is a frontal view showing a schematic configuration of an image forming device in an embodiment.
Figure 2:
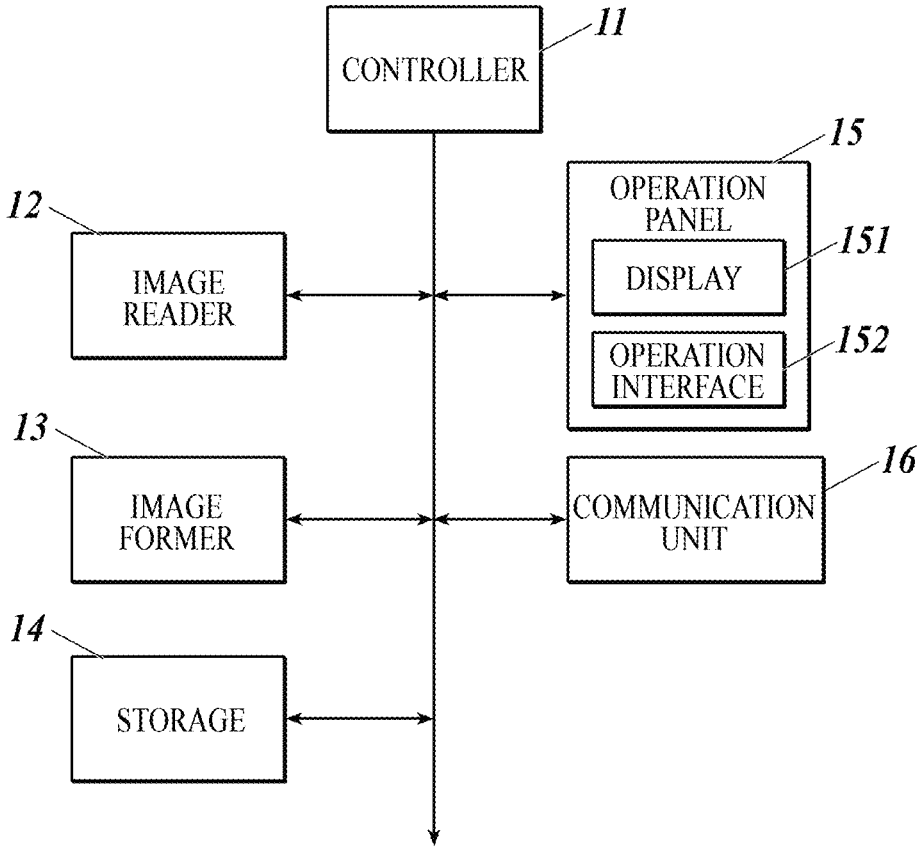
FIG. 2 is a functional block diagram showing a control structure of the image forming device.

The image forming device 10 in this embodiment includes a controller 11, an image reader 12, an image former 13, a storage 14, an operation panel 15 (display 151, operation interface 152), and a communication unit 16, as shown in FIGS. 1 and 2.

The controller 11 includes a CPU, a RAM, and a ROM. According to an operation signal input from the operation interface 152 or a command signal received by the communication unit 16, the CPU reads out various processing programs stored in the ROM, and loads them to the RAM, and centrally controls the operation of the image forming device 10 in cooperation with the various programs loaded to the RAM.

The image reader 12 scans and exposes an image of a document placed on a document table or ADF (auto document feeder) not shown in the drawings by the optical system of the scanning exposure device, reads the reflected light with a line image sensor, and thereby obtains image signals.

After the image signals are processed by A/D conversion, shading correction, compression, or the like, the processed image signals are input as image data to the controller 11. The image data input to the controller 11 is not limited to the data read by the image reader 12, and, for example, may be data received from an external device (not shown in the drawings) via the communication unit 16.

The image former 13 forms an image of four colors of C, M, Y, and K on a sheet according to pixel values of four colors in pixels of the original image that has undergone the image processing.

The image former 13 includes four writing units 131, an intermediate transfer belt 132, a secondary transfer roller 133, and a fixing device 134, as shown in FIG. 1.

The four writing units 131 are arranged in series (tandem) along the belt surface of the intermediate transfer belt 132, and form images of respective colors of C, M, Y, and K The writing units 131 are configured similarly to each other except that the colors of formed images are different. Each of the writing units 131 includes a light exposer 131*a*, a photoreceptor 131*b*, a developer 131*c*, a charger 131*d*, a cleaner 131*e*, and a primary transfer roller 131*f* as shown in FIG. 2.

In image formation, each of the writing units 131 charges the photoreceptor 131*b* by the charger 131*d*, scans the photoreceptor 131*b* with light beams emitted by the light exposer 131*a* on the basis of the original image, and forms an electrostatic latent image. When color materials such as toners are supplied to the developer 131*c* for development, an image is formed on the photoreceptor 131*b*.

The images formed on the respective photoreceptors 131*b* of the four writing units 131 are transferred (primarily transferred) in order to be laid on each other on the intermediate transfer belt 132 by the respective primary transfer rollers 131*f*. An image of the colors is formed on the intermediate transfer belt 132. The intermediate transfer belt 132 is an image carrier which rotates by being rotationally wounded on a plurality of rollers. After the primary transfer, the color materials remaining on the photoreceptors 131*b* are removed by the respective cleaners 131*e*.

The image former 13 feeds a sheet from a manual tray T1 or a sheet feeding tray T2 at the timing when the image on the rotating intermediate transfer belt 132 reaches the position of the secondary transfer roller 133. The secondary transfer roller 133 is one of multiple pairs of rollers: one of each pair is pressed to the intermediate transfer belt 132 and the other rotationally wounds the intermediate transfer belt 132. When the image is transferred (secondarily transferred) onto the sheet from the intermediate transfer belt 132 by pressing of the secondary transfer roller 133, the sheet is conveyed to the fixer 134 to perform fixing processing, and ejected to a sheet ejection tray T3. The fixing processing is fixing the image onto the sheet by heating and pressurizing the sheet with fixing rollers 134*a*. In a case where the image is formed on both sides of the sheet, the sheet is conveyed to a reversing path 135 and reversed, and the sheet is then fed to the position of the secondary transfer roller 133 again.

The storage 14 is anon-volatile storage formed of an HDD (Hard Disk Drive), an SSD (Solid State Drive), or the like, and stores various types of programs, various types of setting data and the like so as to be readable and writable from the controller 11.

The operation panel 15 includes a display 151 that shows various kinds of information to the user, and an operation interface 152 that receives an operation input by the user.

The display 151 includes a color liquid crystal display or the like, and displays an operation screen or the like (various types of setting screens, various types of buttons, operation status of each function, and the like) according to the display control signal input from the controller 11.

The operation interface 152 includes a touch panel that is provided on the screen of the display 151, and various hard keys that are arranged around the screen of the display 151. When a button displayed on the screen is pressed by a finger, a touch pen, or the like, the operation interface 152 detects the X and Y coordinates of the pressed point by the voltage value, and outputs the operation signal corresponding to the detected position to the controller 11. A touch panel is not limited to that of the pressure sensitive type, and may be of the static type or the optical type. When a hard key is pressed, the operation interface 152 outputs the operation signal corresponding to the pressed key to the controller 11. The user can perform setting regarding image formation such as image quality setting, magnification setting, application setting, output setting, and sheet setting, sheet conveyance command, and stop operation of device, by operation via the operation interface 152.

The communication unit 16 is an interface to connect the image forming device 10 via a communication network N. The communication unit 16 includes a communication IC and a communication connector, and sends and receives various kinds of information to and from an external device connected to the communication network N using a predetermined communication protocol under the control of the controller 11. The communication unit 16 can input and output various kinds of information via the USB.

Figure 3:
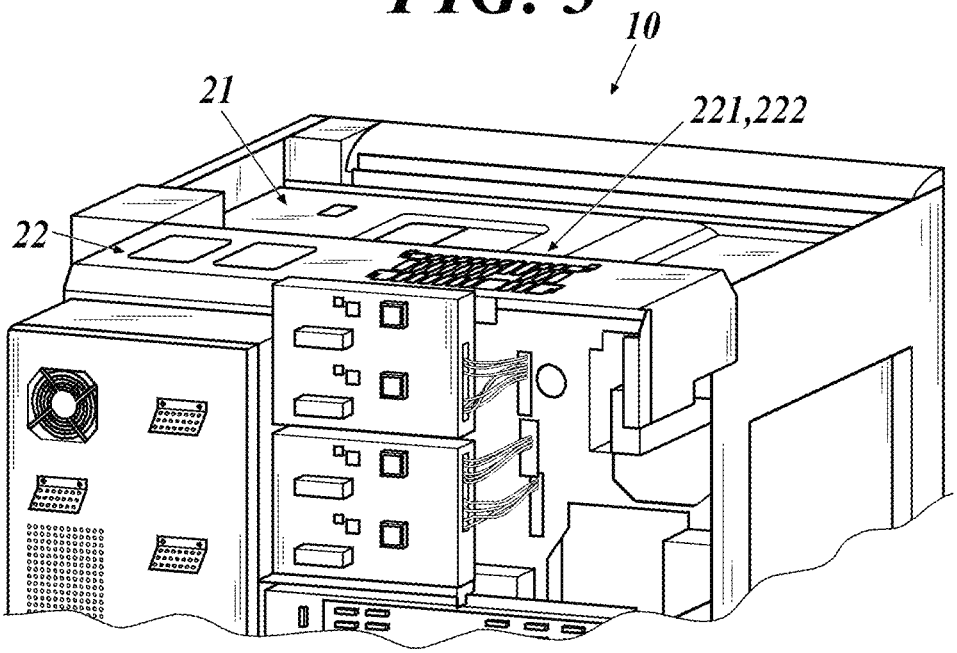
FIG. 3 is a back perspective view showing a functional configuration of the image forming device.

FIG. 3 is a back perspective diagram showing a schematic configuration of the image forming device 10. FIG. 3 shows a schematic configuration of the image forming device 10 without the image reader 12 and the operation panel 15.

As shown in FIG. 3, the image forming device 10 includes a first top plate 21 and a second top plate (top plate) 22 forming the upper part of the case of the device body.

The first top plate 21 is a top plate right under the platen of the image reader 12. The second top plate 22 is a top plate arranged behind the first top plate 21, that is, on the back (further) side of the image forming device 10.

Hereinafter, the second top plate 22 is described in detail.

Figure 4:
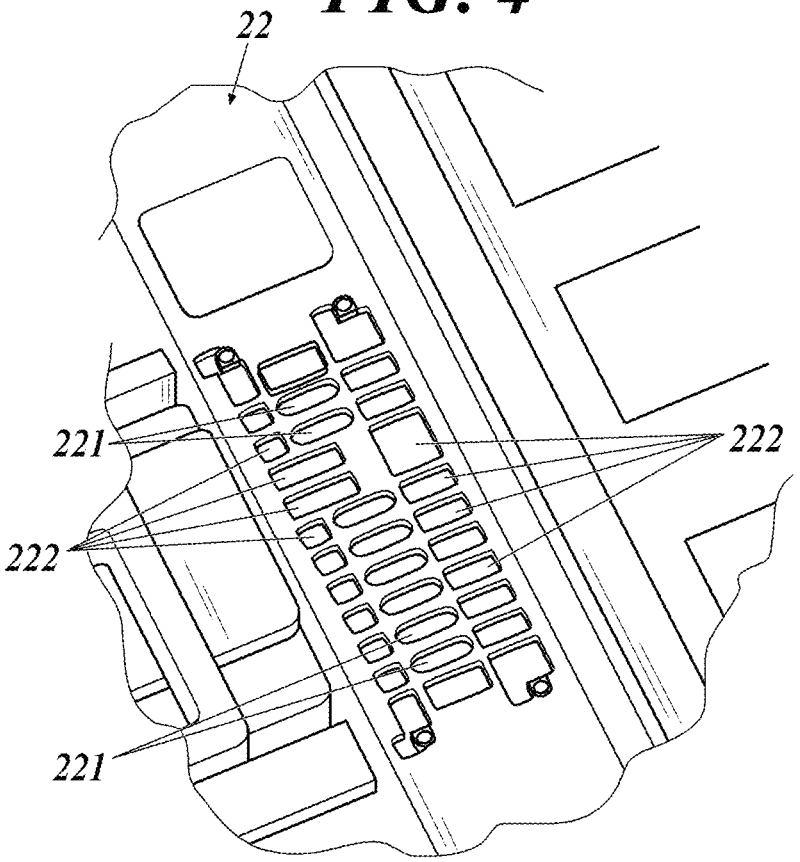
FIG. 4 is a partial enlarged view of an upper face of a second top plate.

The second top plate 22 is formed in a box shape open on the bottom side, and multiple (ex. 8) first holes (first openings (openings)) 221 in an oval shape and multiple (ex. 25) second holes (second openings) 222 are formed on the upper surface of the second top plate 22, as shown in FIGS. 3 and 4. Here, in the image forming device 10 in this embodiment, an exterior plate is formed on the second top plate 22, but in an area of the first holes 221 and the second holes 222 of the second top plate 22, an exterior plate of resin, not an exterior metal plate, is formed.

Figure 5:
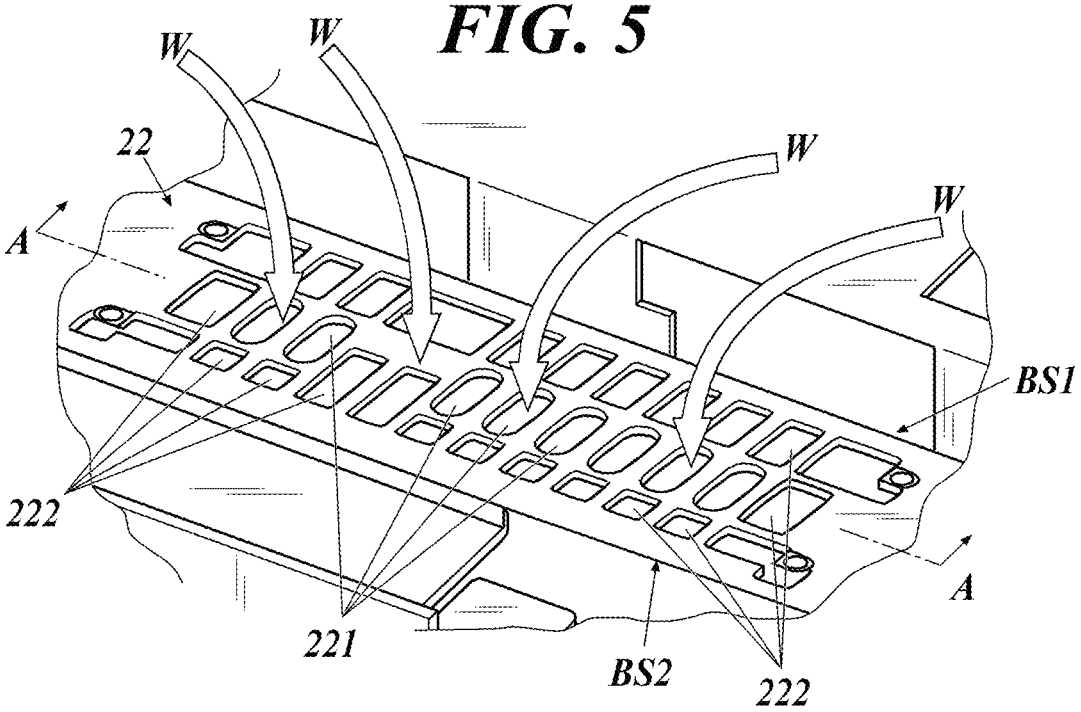
FIG. 5 is a diagram showing a flow of air when air is sucked through the second top plate.

The first holes 221 and the second holes 222 are both suction inlets for sucking air from outside the device as shown in FIG. 5. The arrows in the drawings indicate the flow of air W. Here, for efficient cooling of the device, the proportion of the entire open area of the first holes 221 and the second holes 222 to the area of the fans F used for air suction (see FIG. 7) is preferably 50% or more, and for more efficient cooling of the device, the proportion is preferably 70% or more.

The first hole 221 is formed at a central part on the upper face of the second top plate 22, that is, a part with a comparatively small strength on the upper face of the second top plate 22. The first holes 221 are processed by burring in order to improve the strength of the second top plate 22. The first holes 221 are each in an oval shape as described above so as to be processed by burring easily.

Figure 6:
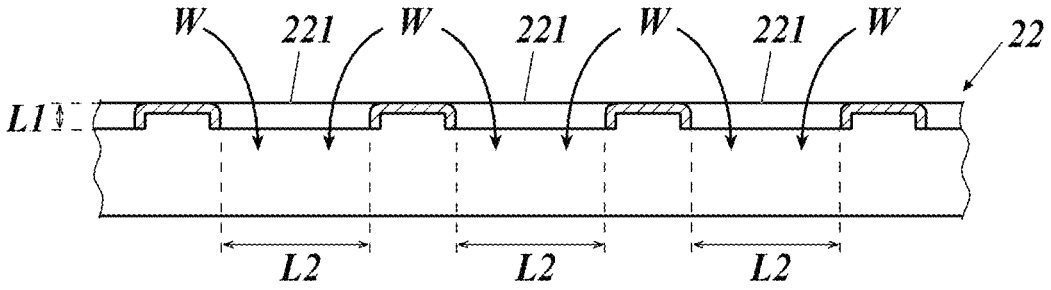
FIG. 6 is a cross-sectional view taken along a line A-A in FIG. 5.

FIG. 6 is a cross-sectional view taken along a line A-A in FIG. 5. The arrows in the drawings indicate the flow of air W.

As shown in FIG. 6, the first holes 221 are processed by burring so that the edges are raised against the direction of air suction for the purpose of suppressing the noise (wind noise) generated by air suction. The first holes 221 have an equal length L1 at the raised edges for the purpose of suppressing the above-described noise more efficiently, and the length L1 of the raised edges is shorter than an opening diameter L2 of the first holes 221.

As shown in FIG. 5, the second holes 222 are formed in series on the upper face of the second top plate 22 near a front side bent section BS1 formed by the upper face and the front lateral face of the second top plate 22, and also formed in series near a back bent section BS2 formed by the upper face and the back lateral face of the second top plate 22. That is, the second holes 222 are formed at positions with a comparatively higher strength on the upper face of the second top plate 22. The second holes 222 are formed at both ends of the group of the first holes 221 formed at a central part on the upper face of the second top plate 22, that is, a part with a comparatively small strength on the upper face of the second top plate 22. That is, as the part of the second top plate 22 where the second holes 222 are formed has a higher strength compared to the part where the first holes 221 are formed, the second holes 222 are processed by burring in this embodiment.

Figure 7:
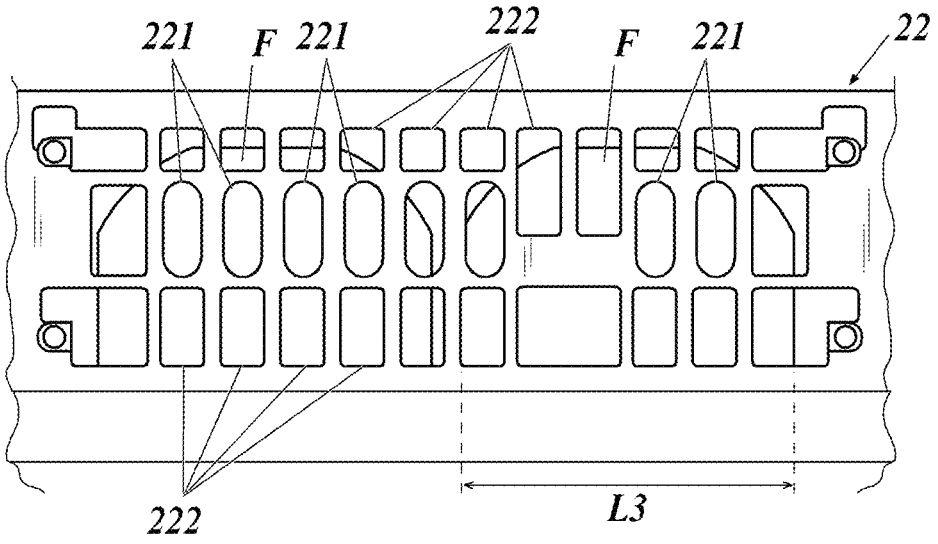
FIG. 7 is a plan view showing a fan through the second top plate.

FIG. 7 is a plan view showing the fans F used when air is sucked from the outside through the second plate 22.

As shown in FIG. 7, the first holes 221 and the second holes 222 are formed such that the opening diameter of each hole is smaller than the diameter L3 of the fans F. This prevents a large object that interferes the operation of the fans F from entering inside through the first holes 221 and the second holes 222.

As described above, the image forming device 10 in this embodiment includes the second top plate 22 forming the case of the device. The first holes (openings) 221 are formed on the second top plate 22, and the first holes 221 are processed by burring.

Therefore, in the image forming device 10 in this embodiment, as the first holes 221 are processed by burring, it is possible to improve the strength of the second top plate 22 and suppress the noise.

In the image forming device 10 in this embodiment, the first holes 221 are suction inlets for sucking air from outside of the device.

Therefore, in the image forming device 10 in this embodiment, it is possible to suppress the noise (wind noise) generated when air is sucked via the first holes 221.

In the image forming device 10 in this embodiment, as the first holes 221 are processed by burring so that the edges are raised against the direction of air suction, it is possible to suppress the noise generated when air is sucked via the first holes 221.

In the image forming device 10 in this embodiment, the first holes 221 are formed on the upper face of the second top plate 22.

Therefore, in the image forming device 10 in this embodiment, as the first holes 221 are processed by burring, it is possible to improve the strength of the upper face of the second top plate 22, making it possible to maintain the durability against impact added on the upper face.

In the image forming device 10 in this embodiment, on the second top plate 22, the first holes (the first openings) 221 are formed, and the second holes (the second openings) that are not processed by burring are formed.

Therefore, in the image forming device 10 in this embodiment, it is possible to take in more of air W via the first holes 221 and the second holes 222, making it possible to improve the cooling performance in the device.

In the image forming device 10 in this embodiment, the first holes 221 are formed at a part with a comparatively high strength of the second top plate 22.

Therefore, in the image forming device 10 in this embodiment, as the first openings 221 that are formed at a part with a comparatively low strength of the second top plate 22 are processed by burring, it is possible to chiefly reinforce the part with a low strength.

In the image forming device 10 in this embodiment, the front bent section BS1 and the back bent section BS2 are provided on the second top plate 22, and the first holes 221 are formed not close to the front bent section BS1 and the back bent section BS2, and the second holes 222 are formed close to the front bent section BS1 and the back bent section BS2.

Therefore, in the image forming device 10 in this embodiment, as the second holes 222 are formed at a part with a strength relatively high of the second top plate 22 close to the front bent section BS1 and the back bent section BS2, it is unnecessary to process the second holes 222 by burring, suppressing the processing cost.

In the image forming device 10 in this embodiment, as the first holes 221 are each in an oval shape, it is easier to process the first holes 221 by burring.

In the image forming device 10 in this embodiment, the second holes 222 are each a square hole.

Therefore, in the image forming device 10 in this embodiment, the open area of the second holes 222 can be larger, improving the cooling performance in the device.

In the image forming device 10 in this embodiment, the first holes 221 are formed such that the length L1 of the raised edge formed by burring is the same for all the first holes 221.

Therefore, in the image forming device 10 in this embodiment, it is possible to prevent the flow of air W taken in via the first holes 221 from being disturbed. It is thereby possible to suppress the noise generated when air is sucked through the first holes 221 even more.

In the image forming device 10 in this embodiment, as each of the first holes 221 is formed such that the length L1 of the raised edge processed by burring is smaller than the opening diameter (hole diameter) L2, it is possible to suppress the noise generated when air is sucked through the first holes 221 more.

In the image forming device 10 in this embodiment, as each of the first holes 221 and the second holes 22 is formed such that the opening diameter is smaller than the diameter L3 of the fans 3, it is possible to prevent a large object that interferes the operation of the fans F from entering through the first holes 221 and the second holes 222.

In the image forming device in this embodiment, the area of the top plate 22 where the first holes 221 are formed is not protected by an exterior metal plate, but as the first holes 221 are processed by burring as described above, it is possible to ensure the durability against impact added to that area.

Though the embodiment according to the present invention has been described in detail, the present invention is not limited to the above embodiment, and changes can be made within the scope of the present invention.

For example, in the above-described embodiment, the shape of the first holes 221 is oval. However, the shape may be of any kind that can be easily processed by burring, and not limited to an oval shape. For example, the shape of the first holes 221 may be circular. The shapes of the first holes 221 are not necessarily uniform, but may include both oval and circular shapes.

The detailed configuration and the detailed operation of the devices included in the image forming apparatus can be suitably changed without leaving the scope of the present invention.

What is claimed is:

1. An image forming device comprising:

a top plate that is part of a case of a body of the image forming device, wherein an opening is formed on the top plate, wherein the opening is processed by burring, wherein the opening is an air suction inlet for air suction from outside of the image forming device, wherein an edge of the opening is processed by burring such that the edge is raised against a direction of the air suction, wherein the opening includes multiple first openings, wherein the multiple first openings are formed on the top plate, wherein multiple second openings that are not processed by the burring are formed on the top plate, and wherein a length of a raised part of the first openings that is formed by the burring is smaller than an opening diameter of the first openings.

2. The image forming device according to claim 1, wherein the opening is formed on an upper face of the top plate.

3. The image forming device according to claim 1, wherein the first openings are formed at a part of the top plate with a strength relatively low.

4. The image forming device according to claim 1, wherein the first openings are each in a circular shape or an oval shape.

5. The image forming device according to claim 1, wherein the second openings are each a hole in a square shape.

6. The image forming device according to claim 1, wherein the length of the raised part of each of the first openings that is formed by the burring is equal among the multiple first openings.

7. The image forming device according to claim 1, wherein a diameter of each of the first openings and the second openings is smaller than a diameter of a fan used in the air suction.

8. The image forming device according to claim 1, wherein at least a part of the top plate where the first openings are formed is not protected by an exterior metal plate.

9. An image forming device comprising:

a top plate that is part of a case of a body of the image forming device, wherein an opening is formed on the top plate, wherein the opening is processed by burring, wherein the opening is an air suction inlet for air suction from outside of the image forming device, wherein at least part of the opening is processed by burring such that the at least part of the opening is raised against a direction of the air suction, wherein the opening includes multiple first openings, wherein the multiple first openings are formed on the top plate, wherein multiple second openings that are not processed by the burring are formed on the top plate, and wherein a proportion of an entire open area of the openings to an area of a fan used for the air suction is 50% or more.

10. An image forming device comprising:

a top plate that is part of a case of a body of the image forming device, wherein an opening is formed on the top plate, wherein the opening is processed by burring, wherein the opening is an air suction inlet for air suction from outside of the image forming device, wherein at least part of the opening is processed by burring such that the edge is raised against a direction of the air suction, wherein the opening includes multiple first openings, wherein the multiple first openings are formed on the top plate, wherein multiple second openings that are not processed by the burring are formed on the top plate, wherein a bent section is provided on the top plate, wherein the first openings are formed at a part not close to the bent section, and wherein the second openings are formed at a part close to the bent section.

* * * * *